US007884791B2

(12) United States Patent
Tseng et al.

(10) Patent No.: US 7,884,791 B2
(45) Date of Patent: Feb. 8, 2011

(54) LIQUID CRYSTAL DISPLAY AND OVER DRIVING METHOD THEREOF

(75) Inventors: Sheng-Pin Tseng, Tao-Yuan Hsien (TW); Ching-Chao Chang, Tao-Yuan Hsien (TW); Po-Sheng Shih, Tao-Yuan Hsien (TW)

(73) Assignee: Hannstar Display Corporation, Tao-Yuan Hsien (TW)

( * ) Notice: Subject to any disclaimer, the term of this patent is extended or adjusted under 35 U.S.C. 154(b) by 784 days.

(21) Appl. No.: 11/456,598

(22) Filed: Jul. 11, 2006

(65) Prior Publication Data

US 2008/0013126 A1 Jan. 17, 2008

(51) Int. Cl.
*G09G 3/36* (2006.01)

(52) U.S. Cl. ..... 345/89

(58) Field of Classification Search ..... 345/86–104, 345/690

See application file for complete search history.

(56) References Cited

U.S. PATENT DOCUMENTS

| | | | | |
|---|---|---|---|---|
| 4,808,989 | A * | 2/1989 | Tabata et al. | 345/545 |
| 5,880,744 | A * | 3/1999 | Bradstreet | 345/530 |
| 6,825,824 | B2 | 11/2004 | Lee | |
| 2002/0149574 | A1 | 10/2002 | Johnson et al. | |
| 2003/0098839 | A1 * | 5/2003 | Lee | 345/89 |
| 2003/0179175 | A1 * | 9/2003 | Shigeta et al. | 345/101 |
| 2004/0125062 | A1 * | 7/2004 | Yamamoto et al. | 345/87 |
| 2005/0073630 | A1 | 4/2005 | Chen et al. | |
| 2005/0099549 | A1 * | 5/2005 | Chen et al. | 349/41 |
| 2006/0103682 | A1 | 5/2006 | Kunimori et al. | |

FOREIGN PATENT DOCUMENTS

| | | | |
|---|---|---|---|
| EP | 1 353 318 | | 10/2003 |
| WO | WO 99/46754 | * | 9/1999 |

OTHER PUBLICATIONS

Sluyterman and Boonekamp; "Architectural Choices in a Scanning Backlight for Large LCD TVs;" SID 05 Digest; pp. 996-999, 2005.

* cited by examiner

*Primary Examiner*—Amr Awad
*Assistant Examiner*—Kenneth Bukowski
(74) *Attorney, Agent, or Firm*—Thomas, Kayden, Horstemeyer & Risley, LLP

(57) ABSTRACT

The present invention provides an over driving circuit of a liquid crystal display is provided. The circuit comprises a buffer, a memory coupling with the buffer and a modifier coupling with the buffer, the memory and a signal line. This signal line is used to transfer a row number signal to the modifier. The modifier may generate a corrected gray level value to a pixel unit based on a gray level value of present frame from the buffer, a gray level value of previous frame from the memory and the row number signal.

15 Claims, 7 Drawing Sheets

| $G_n'$ | | $G_n$ | | | | | | | |
|---|---|---|---|---|---|---|---|---|---|
| | | 0 | 1 | 2 | 3 | ··· | 253 | 254 | 255 |
| $G_{n-1}$ | 0 | 0 | 1 | 2 | 3 | ··· | 255 | 255 | 255 |
| | 1 | 0 | 1 | 2 | 3 | ··· | 255 | 255 | 255 |
| | 2 | 0 | 1 | 2 | 3 | ··· | 255 | 255 | 255 |
| | 3 | 0 | 1 | 2 | 3 | ··· | 255 | 255 | 255 |
| | ⋮ | ⋮ | ⋮ | ⋮ | ⋮ | ⋮ | ⋮ | ⋮ | ⋮ |
| | 253 | 0 | 0 | 0 | 0 | ··· | 253 | 254 | 255 |
| | 254 | 0 | 0 | 0 | 0 | ··· | 253 | 254 | 255 |
| | 255 | 0 | 0 | 0 | 0 | ··· | 252 | 253 | 255 |

LUT (640)

| $G_n'$ | | $G_{n-1}$ | |
|---|---|---|---|
| | | 80 | 96 |
| $G_n$ | 160 | 208 | 192 |
| | 176 | 240 | 208 |

LUT (672)

| $G_n'$ | | $G_{n-1}$ | |
|---|---|---|---|
| | | 80 | 96 |
| $G_n$ | 160 | 216 | 200 |
| | 176 | 242 | 210 |

| $G_n'$ | | $G_n$ | | | | |
|---|---|---|---|---|---|---|
| | | 0 | ... | 128 | ... | 255 |
| $Y_{th}$ | 1 | | | 140 | | |
| | ⋮ | | | | | |
| | 384 | | | 160 | | |
| | ⋮ | | | | | |
| | 768 | | | 200 | | |

LIQUID CRYSTAL DISPLAY AND OVER DRIVING METHOD THEREOF

FIELD OF THE INVENTION

The present invention relates to an over driving method, and more particularly to an over driving technique to improve the response time of a liquid crystal display.

BACKGROUND OF THE INVENTION

Liquid crystal display has been used in various electronic devices. Because liquid crystal molecules do not generate light by themselves, a back light module is required for providing light on a liquid crystal display.

Typically, there are two types of backlight module in liquid crystal display. One is always-lighting type backlight module. The other one is flash type backlight module. The flash type backlight module, for example, is applied to liquid crystal display driven by a color sequential method.

According to the color sequential method, three primary colors are sequentially switched in the persistence of vision time to compose a color. That is the primary colors are sequentially displayed in three time segments. Therefore, a complete color image is displayed as a rapidly changing sequence of primary monochrome images. Since every pixel unit in the display contributes to every primary image, a color sequential imaging display must address pixel unit first to select which pixel unit to display.

When addressing the pixel units in a liquid crystal panel, the scan lines are scanned from the top to the bottom. Then, the backlight module is turned on to display a specific gray-level image on the panel. Since the top scan line is scanned first and the bottom scan line is scanned last. Therefore, a time difference exists in these scan lines. Such time difference causes different response time for liquid crystal molecule to rotate. That is the liquid crystal molecule located in the top scan lines has more response time to rotate. The liquid crystal molecule located in the bottom scan lines has less response time to rotate. Therefore, an over driving technique is disclosed to compensate the response time difference. Accordingly, a specific voltage is corresponded to a specific rotation angle of liquid crystal molecule. A response time is required for liquid crystal molecule to rotate to the specific angle. When a higher voltage is applied to liquid crystal molecule, liquid crystal molecule has a higher rotation velocity. The over driving technique uses an over driving voltage that is higher than the target voltage to accelerate the rotation of liquid crystal molecule to reduce the required response time. When the liquid crystal molecule rotates to the angle corresponding to the target voltage, the overdriving voltage is then reduced to the target voltage.

Typically, a look up table as shown in FIG. 1 is used for determining the over driving voltage. According to FIG. 1, two parameters are used to search the over driving voltage. The first parameter is the gray-level value $G_n$ of the present frame. The second parameter is the gray-level value $G_{n-1}$ of the previous frame. The $G_n'$ is the output gray-level value. For example, the gray-level value $G_n$ is 2 and the gray-level value $G_{n-1}$ is 253. After searching the look up table, the output gray-level value $G_n'$ can be obtained from the table as 0.

FIG. 1B is a typical schematic diagram of an over driving circuit. The over driving circuit 100 comprises a buffer 101, a memory 102 and a modifier 103. When the over driving circuit 100 receives an image gray level value, such as the gray level value $G_n$, of a frame time of a pixel unit, the gray level value $G_n$ is sent to the memory 102 through the buffer 101. Moreover, the gray level value $G_n$ is also sent to the modifier 103. The modifier 103 may search the look up table according to the gray level value $G_n$ and the gray level value $G_{n-1}$ of previous frame stored in the memory 102 to determine a corrected gray-level value $G_n'$. Then, the corrected gray-level value $G_n'$ is output from a serializer 104.

Then, the corrected gray-level value $G_n'$ is sent to a corresponding device, such as a driver IC. The driver IC translates the gray-level value $G_n'$ into corresponding voltage which controls the rotation angle of liquid crystal molecule. Then, the backlight module is turned on to generate light on the liquid crystal molecule. Liquid crystal molecule with specific rotation angle allows the liquid crystal panel to display image with a specific gray level.

The scan lines are scanned from the top to the bottom. Therefore, time difference exists in these scan lines. However, the typical over driving circuit and method only uses two parameters, the gray-level value of the present frame and the gray-level value of the previous frame, to search the corrected gray level value. Such circuit and method does not really consider the time difference among the scan lines.

SUMMARY OF THE INVENTION

The main purpose of the present invention is to provide an over driving method for a liquid crystal display to resolve the insufficient response time problem.

Accordingly, the over driving method comprises the following steps of providing a modifier including at least one gray-level look up table; inputting a first gray-level value, a second gray-level value and a row number signal to the modifier, wherein the row number signal is corresponding to at least one gray-level look up table; obtaining a corrected value from at least one gray-level look up table according to the first gray-level value and the second gray-level value; and determining an over driving voltage based on the corrected value.

According to the over driving method of the present invention, the corrected value is obtained by searching the at least one gray-level look up table or calculation based on the at least one gray-level look up table.

According to the over driving method of the present invention, the modifier further comprises a first reference gray-level value look up table and a second reference gray-level value look up table.

According to the over driving method of the present invention, the gray-level look up table is obtained by linear interpolating or nonlinear interpolating the first reference gray-level value look up table and the second reference gray-level value look up table.

According to the over driving method of the present invention, the first reference gray-level value look up table includes a first reference corrected gray-level value obtained by searching the first reference gray-level value look up table or calculation based on the first reference gray-level value look up table.

According to the over driving method of the present invention, the second reference gray-level value look up table includes a second reference corrected gray-level value obtained by searching the second reference gray-level value look up table or calculation based on the second reference gray-level value look up table.

According to the over driving method of the present invention, the first gray-level value is the present gray-level value and the second gray-level value is the previous gray-level value.

According to the over driving method of the present invention, the second gray-level value is a fixed value composed of a plurality of bits between all bits equal to 0 and all bits equal to 1.

According to the purpose, the over driving method further comprises the steps of inputting the over driving voltage to a switch device; utilizing the switch device to control the rotation angle of the liquid crystal molecule; turning on a backlight module to generate light on the liquid crystal molecule; and generating a curve of brightness versus time through the operation of the liquid crystal molecule.

According to the over driving method, the integrated values of the brightness versus time in a sub-frame according to the curve are all identical in the liquid crystal display.

According to another purpose of the present invention, an over driving circuit of a liquid crystal display is provided. The circuit comprises a buffer, a memory coupling with the buffer and a modifier coupling with the buffer, the memory and a signal line. This signal line is used to transfer a row number signal to the modifier.

According to the over driving circuit of the present invention, the buffer is used to output a first gray-level value.

According to the over driving circuit of the present invention, the first gray-level is transferred to the memory and the modifier.

According to the over driving circuit of the present invention, the memory is used to output a second gray-level value.

According to the over driving circuit of the present invention, the second gray-level is transferred to the modifier.

According to the over driving circuit of the present invention, a row number signal is transferred to the modifier.

According to the over driving circuit of the present invention, a corrected gray-level value is sent out from the modifier.

According to the over driving circuit of the present invention, the circuit further comprises a serializer to receive the corrected gray-level value.

According to the over driving circuit of the present invention, the modifier further comprises a gray-level look up table related to the row number signal.

Therefore, the corrected gray-level value output from the over driving circuit and operation method of the present invention is not only based on the gray-level values of the present and previous frame of a pixel unit but also based on the row number of this pixel unit. Such circuit and operation method may compensate the response time difference of the liquid crystal molecules due to different scan lines.

Accordingly, the over driving circuit and operation method of the present invention is used in a liquid crystal display with a scan type backlight module or a flash type backlight module, such as a liquid crystal display driven by a color sequential method.

BRIEF DESCRIPTION OF THE DRAWINGS

The foregoing aspects and many of the attendant advantages of this invention are more readily appreciated and better understood by referencing the following detailed description, when taken in conjunction with the accompanying drawings, wherein.

DETAILED DESCRIPTION OF THE PREFERRED EMBODIMENT

Figures 1A, 1B:
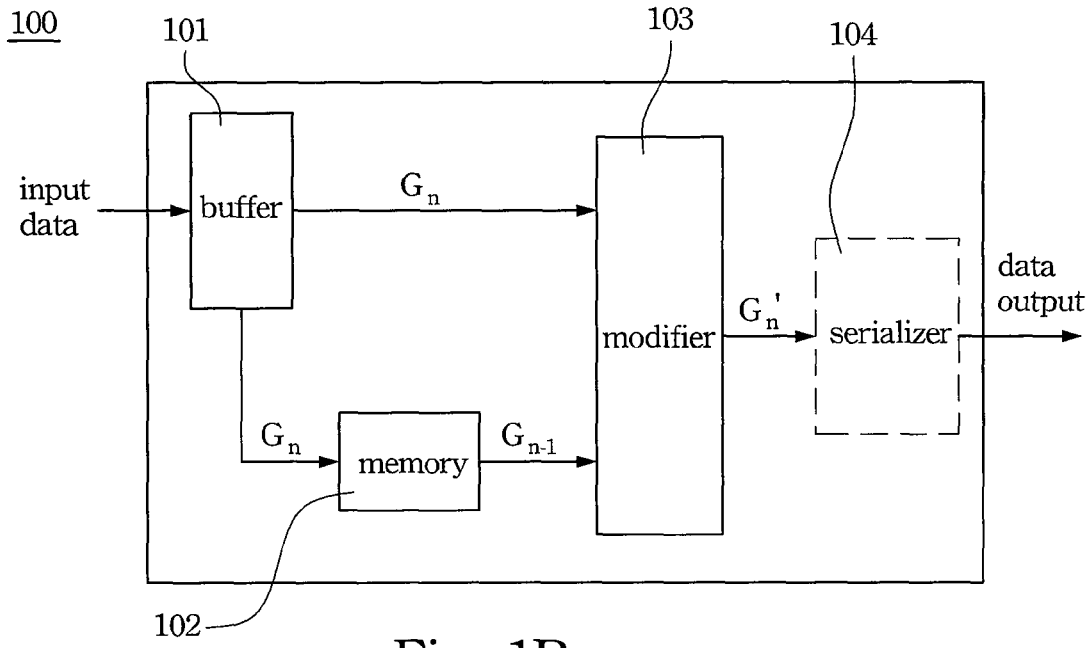
Fig. 1A (PRIOR ART)
Fig. 1B (PRIOR ART)
FIG. 1A is a typical gray-level look up table.
FIG. 1B is a typical over-driving circuit.
Figure 2A:
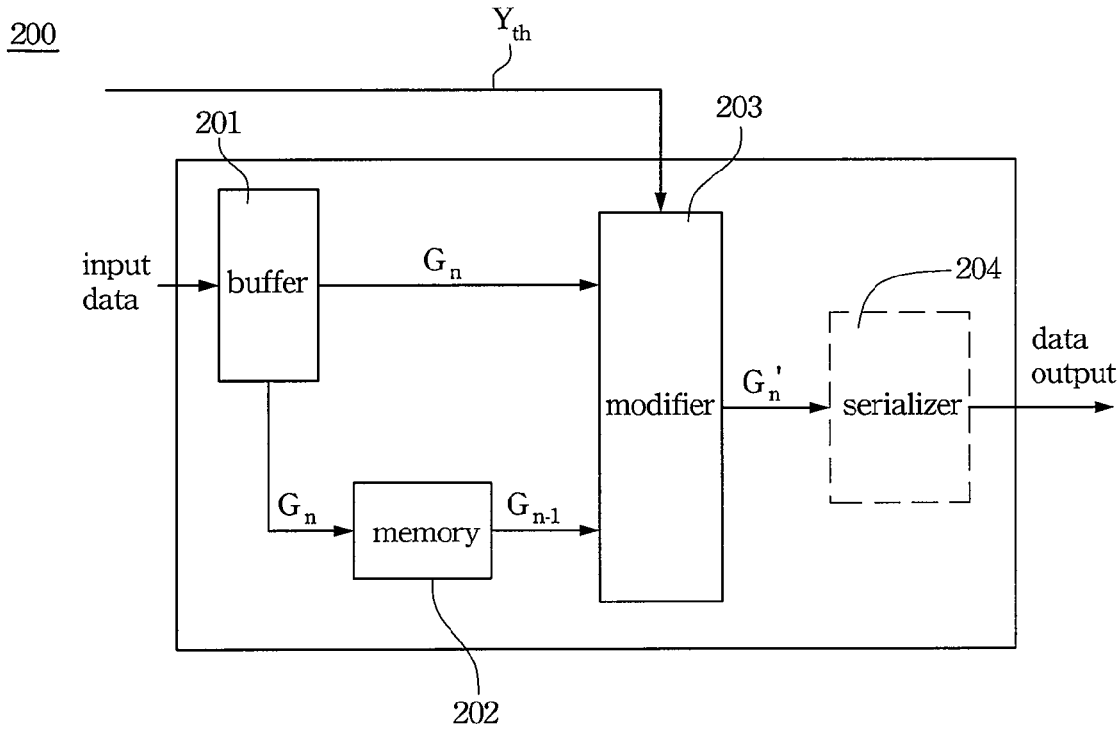
FIG. 2A is an over-driving circuit according to a preferred embodiment of the present invention.

FIG. 2A is a schematic diagram of an over driving circuit according to an embodiment of the present invention. The over driving circuit 200 comprises a buffer 201, a memory 202 and a modifier 203. When the over driving circuit 200 receives an image gray level value, such as the first gray level value $G_n$, of a frame time of a pixel unit, such as the first pixel unit, the first gray level value $G_n$ is temporary stored in the buffer 201. After the previous image gray level value, such as the second gray level value $G_{n-1}$, of previous frame time of the first pixel unit stored in the memory 202 is transferred to the modifier 203, the first gray level value $G_n$ is sent from the buffer 201 to the memory 202. On the other hand, the first gray level value $G_n$ is also sent to the modifier 203. The modifier 203 may search the look up table based on the first gray level value $G_n$ and the second gray level value $G_{n-1}$ sent from the memory 202 to obtain a corrected gray-level value $G_n'$. It is noticed that the over driving circuit of the present invention further comprises an interface, such as a serializer 204, for outputting the corrected gray-level value $G_n'$.

According to the corrected gray-level value $G_n'$, an over driving voltage is determined. This over driving voltage is sent to corresponding devices in a liquid crystal display. In an embodiment, the switch devices are thin film transistors. These switch devices may control the rotation of liquid crystal molecule. Then, the backlight module is turned on to generate light. The generated light is illuminated on the rotated liquid crystal molecule. Because of different rotation angles of the liquid crystal molecule, a specific gray level (brightness) is presented on the liquid crystal display. Therefore, a curve of brightness versus time is generated.

Comparing with the typical over driving circuit, the main difference is that the modifier 203 in the present invention is also controlled by a row number signal $Y^{th}$. This row number signal $Y^{th}$ is used to provide the modifier 203 the row number of this first pixel unit. Then, the modifier 203 may search the corresponding gray-level look up table based on this row number. In other words, the modifier 203 comprises a plurality of gray-level look up tables corresponding to different rows. For example, the modifier 203 includes 768 gray-level look up tables corresponding to 768 rows respectively for a liquid crystal display with 1024×768 resolution. While searching the corrected gray-level value based on the row number signal $Y^{th}$, a gray-level look up table corresponding to $Y^{th}$ row is searched first. Then, a corrected gray-level value can be obtained and output according to the image gray-level value of the previous and present frame of the first pixel unit.

Figure 2B:
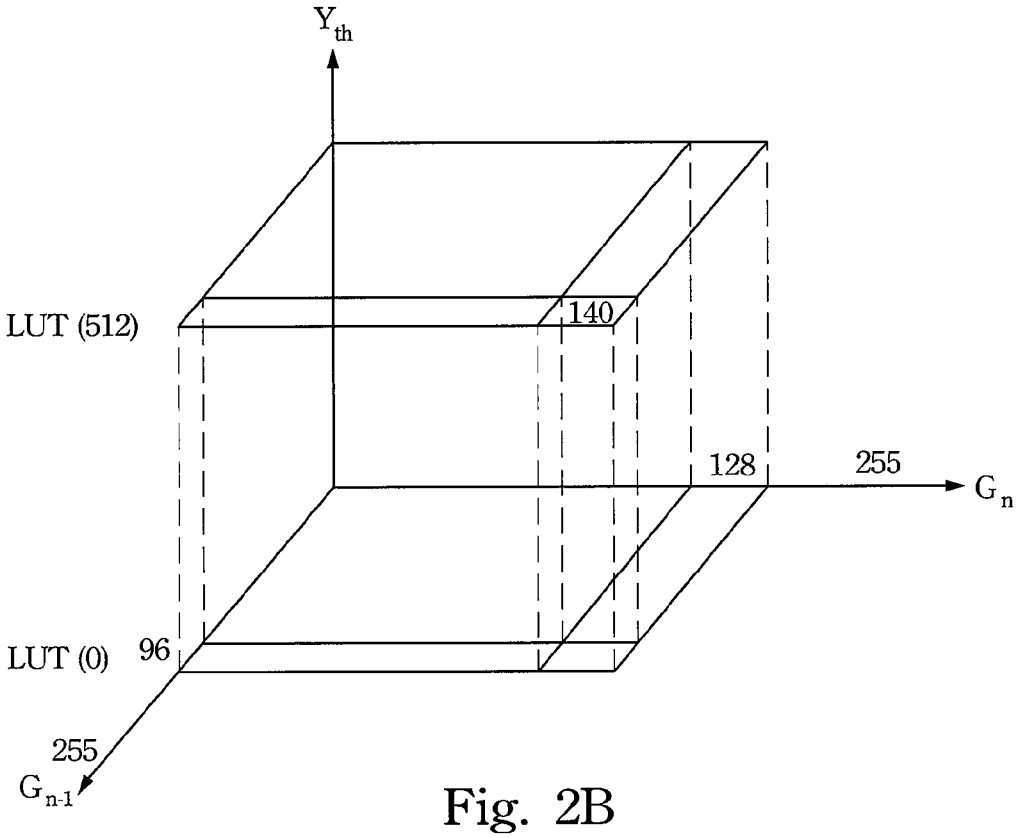
FIG. 2B is a schematic diagram of using the over-driving circuit of the present invention to search a corrected gray-level value.

FIG. 2B is a schematic diagram of using the over-driving circuit of the present invention to search a corrected gray-level value. According to the present invention, three parameters are used to search the corrected gray-level value. The first parameter is the gray-level value of the present frame, the first gray-level value $G_n$. The second parameter is the gray-level value of the previous frame, the second gray-level value $G_{n-1}$. The third parameter is the row number signal $Y^{th}$. For example, in an embodiment, a corrected gray-level value of a pixel unit located in the $512^{th}$ row is searched. The first gray-level value $G_n$ of this pixel unit is 128. The second gray-level value $G_{n-1}$ of this pixel unit is 96. The row number signal $Y^{th}$ is 512. Therefore, the corrected gray-level value is 140 based on the three parameters.

Accordingly, a plurality of gray-level look up tables are consisted in the modifier 203 of the present invention. Moreover, the modifier 203 is controlled by the row number signal $Y^{th}$. Therefore, while searching the corrected gray-level value, a gray-level look up table corresponding to the row of the first pixel unit located is searched first. Then, a corrected gray-level value is obtained based on the real gray-level values of the present and previous frame of the first pixel unit. In other words, the corrected gray-level value searching are not only based on the real gray-level values of the present and previous frame of the first pixel unit but also based on the row where the first pixel unit is located. Therefore, the searched corrected gray-level value may match better to the environment conditions.

In another embodiments, a possible problem is that too many gray-level look up tables stored in the modifier 203 leads to lengthy searching time. In order to reduce modifier 203 loading, a linear interpolation method or a nonlinear interpolation method is used in the present invention to reduce the required number of the gray-level look up tables. The linear interpolation method is described in the following embodiment.

Figures 3A, 3B, 3C:
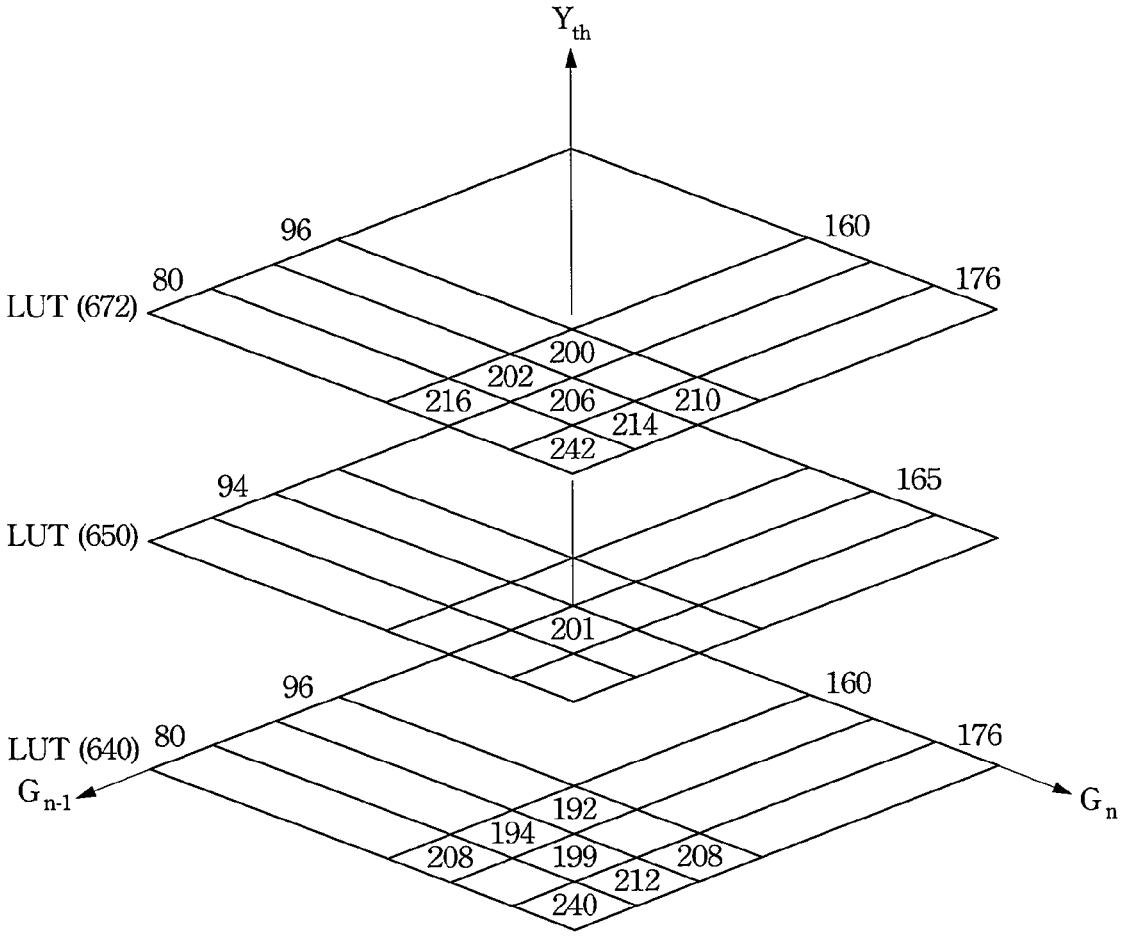
FIG. 3A is a partial gray-level look up table LUT (640) based on the $640^{th}$ scan line.
FIG. 3B is a partial gray-level look up table LUT (672) based on the $672^{nd}$ scan line.
FIG. 3C is a schematic diagram of using a linear interpolation method to obtain a corresponding corrected gray-level value.

In an embodiment, one gray-level look up table contains corrected gray-level values for 32 scan lines. In each gray-level look up table, both the first gray-level value $G_n$ and the second gray-level value $G_{n-1}$ are changed by 16 gray-level. Therefore, in an example, the pixel unit is located in the $650^{th}$ scan line. The second gray-level value $G_{n-1}$ of the previous frame of the pixel unit is 94. The first gray-level value $G_n$ of the present frame of the pixel unit is 165. The following will describe how to obtain a corrected gray-level value by the linear interpolation method based on the foregoing conditions. FIG. 3A is a partial gray-level look up table LUT (640) of the $640^{th}$ scan line. FIG. 3B is a partial gray-level look up table LUT (672) of the $672^{nd}$ scan line. FIG. 3C is a schematic diagram of using the linear interpolation method to obtain a corresponding corrected gray-level value. According to the present invention, three parameters are used to search the corrected gray-level value. The first parameter is the gray-level value of the present frame, the first gray-level value $G_n$. The second parameter is the gray-level value of the previous frame, the second gray-level value $G_{n-1}$. The third parameter is the row number signal $Y^{th}$.

First, the linear interpolation method is illustrated in the FIG. 3A to obtain the corrected gray-level value when the first gray-level value $G_n$ is 160 and the second gray-level value $G_{n-1}$ is 94. The calculation is shown in the following.

Corrected gray-level value=(192−208)×(94−80)/(96−80)+208=194

Next, the corrected gray-level value is calculated when the first gray-level value $G_n$ is 176 and the second gray-level value $G_{n-1}$ is 94. The calculation is shown in the following.

Corrected gray-level value=(208−240)×(94−80)/(96−80)+240=212

Next, the corrected gray-level value is calculated when the first gray-level value $G_n$ is 165 and the second gray-level value $G_{n-1}$ is 94. The calculation is shown in the following.

Corrected gray-level value=(212−194)×(165−160)/(176−160)+194=199

Then, the linear interpolation method is illustrated in the FIG. 3B to obtain the corrected gray-level value when the first gray-level value $G_n$ is 160 and the second gray-level value $G_{n-1}$ is 94. The calculation is shown in the following Corrected gray-level value=(200−216)×(94−80)/(96−80)+216=202

Next, the corrected gray-level value is calculated when the first gray-level value $G_n$ is 176 and the second gray-level value $G_{n-1}$ is 94. The calculation is shown in the following.

Corrected gray-level value=(210−242)×(94−80)/(96−80)+242=214

Next, the corrected gray-level value is calculated when the first gray-level value $G_n$ is 165 and the second gray-level value $G_{n-1}$ is 94. The calculation is shown in the following.

Corrected gray-level value=(214-202)×(165−160)/(176−160)+202=206

Finally, the corrected gray-level value of the $650^{th}$ scan line can be obtained by using the linear interpolation method to calculate as following.

Corrected gray-level value=(206−199)×(650−640)/(672−640)+199=201

Therefore, the final corrected gray-level output value is 201.

Figure 4:
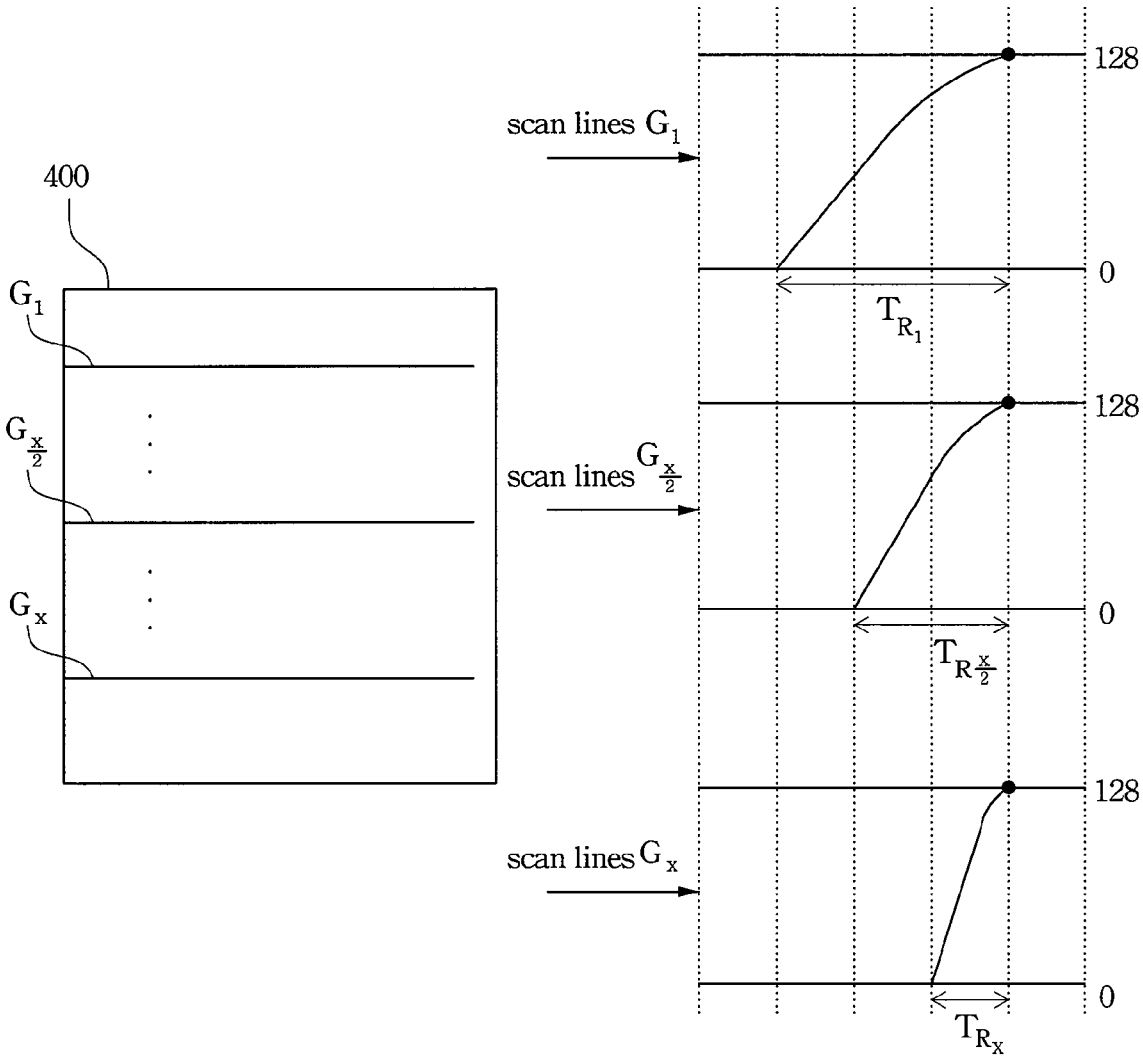
FIG. 4 is a schematic comparing diagram of using the over driving circuit of the present invention to correct the scan voltage of the scan line.

FIG. 4 is a schematic comparison diagram of using the over driving circuit of the present invention to correct the gray-level value of the scan line. The X-axis represents the time and the Y-axis represents the brightness. The curve is brightness versus time. According to the present invention, the corrected gray-level value relates to the gray-level value changed between the previous and present frame of a pixel unit and the row number of the pixel unit. Therefore, the scan lines is scanned from the scan line $G_1$ to scan line $G_x$ when a liquid crystal panel 400 has scan lines $G_1, \ldots G_{x/2} \ldots, G_x$. In other words, when addressing the row address, the scan line $G_1$ is addressed first and the scan line $G_x$ is addressed later. Therefore, the time difference existing in these scan lines leads the liquid crystal molecules to have different response time.

For example, the gray level values of the whole panel 400 transit from level 0 to level 128, the liquid crystal molecule located in the scan line $G_1$ has response time $T_{R1}$. The liquid crystal molecule located in the scan line $G_{X/2}$ has response time $T_{RX/2}$. The liquid crystal molecule located in the scan line $G_X$ has response time $T_{RX}$. The response time $T_{R1}>T_{Rx/2}>T_{Rx}$. However, because row number of the scan line is also considered in the present invention, different over driving voltages are applied to the two pixel units located in different scan lines even though the two pixel units have the same gray-level value changed between two sequential frames. From FIG. 4, different over driving voltages are applied to pixel units located in different scan lines. The pixel units located in the scan line $G_1$ require the least over driving voltages. The pixel units located in the scan line $G_X$ require the largest over driving voltages. The reason is that the liquid crystal located in the scan line $G_X$ has the least response time $T_{Rx}$ because the scan line $G_X$ is scanned last. Therefore, the largest over driving voltage is required to rotate the liquid crystal molecule to the required position associated with specific gray level. In other words, according to the present invention, the gray-level look up table relates to the row number. Because the corrected gray-level value $G_n$ is changed based on the row number, the rotation of the liquid crystal molecule and turning on the backlight module time can still match each other. Therefore, a uniform gray-level brightness is presented on the liquid crystal display panel.

Figure 5:
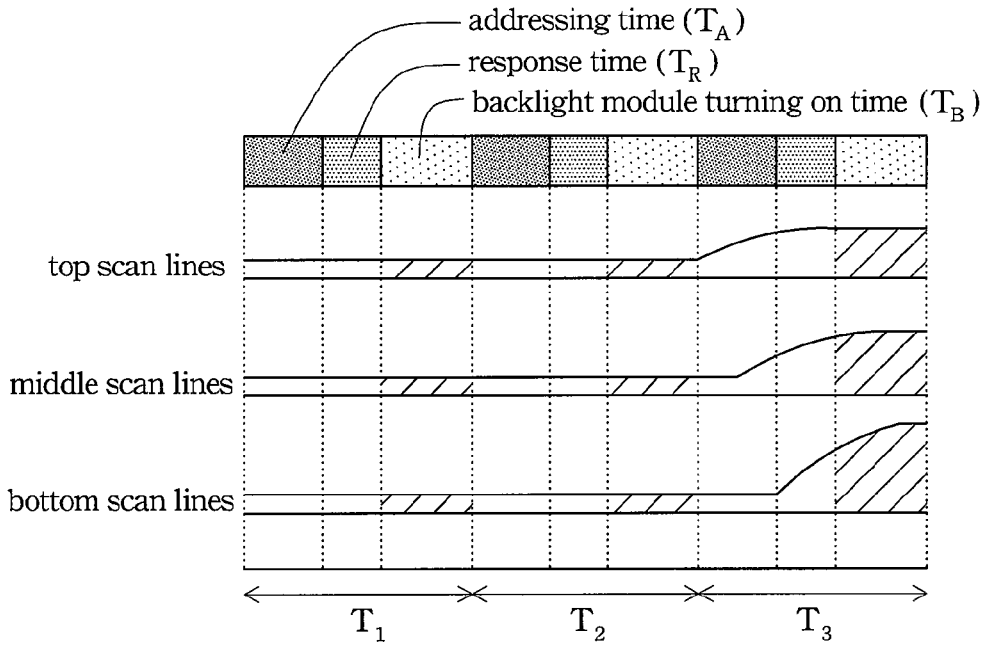
FIG. 5 is a schematic time sequence diagram used in a color sequential method according to the first embodiment of the present invention.

FIG. 5 is a schematic time sequence diagram used in a color sequential method according to the first embodiment of the present invention. In this embodiment, the liquid crystal panel is supposed to represent the same gray-level value. The frame time T is separated to three sub-frames $T_1$, $T_2$ and $T_3$. The three sub-frames $T_1$, $T_2$ and $T_3$ are used to sequentially show three primary colors in the persistence of vision time. Any color can be created by mixing the three primary colors. There is not any reset time between two frames.

In this embodiment, each sub frame, such as the sub frame $T_1$, is divided into three time segments $T_A$, $T_R$ and $T_B$. The time segment $T_A$ is the addressing time. Because the color sequential method is used in this embodiment, an addressing process is required to apply voltage to corresponding address before each primary color is shown. The time segment $T_R$ is the response time for the liquid crystal molecule to rotate to a specific angle. The time segment $T_B$ is the time for the backlight module to be turned on.

When the liquid crystal molecule is rotated to a specific angle, the backlight module is turned on to show a primary color. In an embodiment, when the whole liquid crystal panel displays an image with the same gray-level value, the response time of the liquid crystal molecule located in the top scan line is longer than the response time of the liquid crystal molecule located in the bottom scan line because the scan lines are sequentially scanned from the top to the bottom. Therefore, a larger over driving voltage is sent to the bottom scan line to accelerate the rotation velocity of the liquid crystal molecule located therein to compensate the difference of the response time. As shown in the sub frame $T_3$, the slope of the brightness versus time curve of the bottom scan line is larger than the slope of the brightness versus time curve of the middle and top scan line. Therefore, the rotation velocity of the liquid crystal molecule located in the bottom scan line is larger than the rotation velocity of the liquid crystal molecule located in the middle and top scan line. In the time segment $T_B$, all scan lines have the same integrated values of the brightness versus time curve. Therefore, a uniform gray-level brightness is represented on the liquid crystal panel in the time segment $T_B$.

Figure 6:
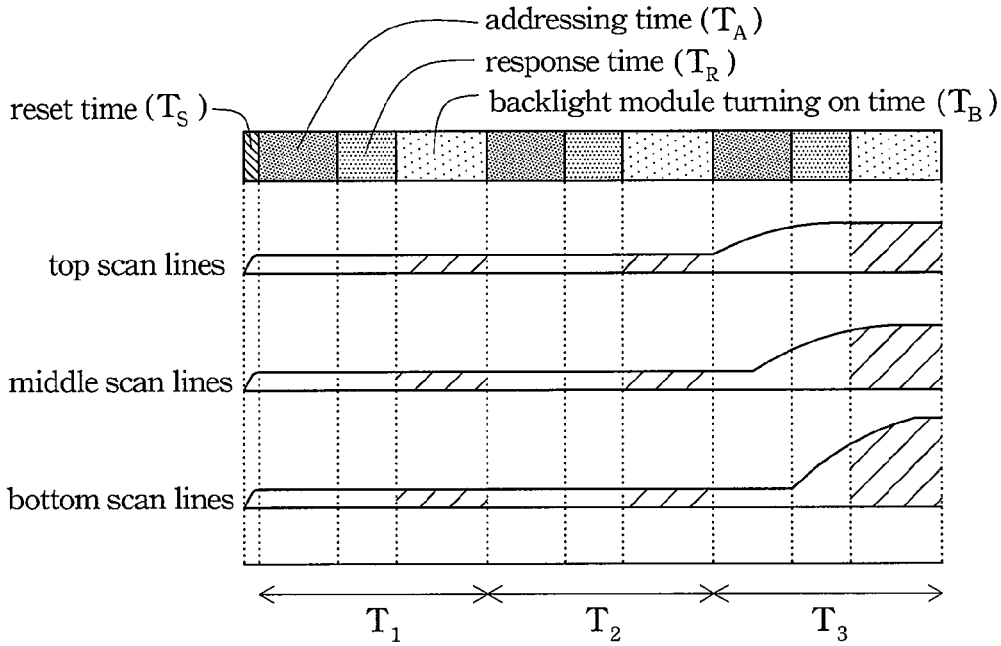
FIG. 6 is a schematic time sequence diagram used in a color sequential method according to the second embodiment of the present invention.

FIG. 6 is a schematic time sequence diagram used in a color sequential method according to the second embodiment of the present invention. In this embodiment, the liquid crystal panel is supposed to display an image with the same gray-level value. The frame time T is separated to three sub-frames $T_1$, $T_2$ and $T_3$. The three sub-frames $T_1$, $T_2$ and $T_3$ are used to sequentially show three primary colors in the persistence of vision time. A color can be created by mixing the three primary colors. The main difference between the first embodiment and the second embodiment is that a reset time $T_s$ exists between two frames. For example, for a 8 bits case, the reset time $T_s$ is used to reset the display of the liquid crystal panel to a specific gray level value, such as 0 gray level value (black color) or 255 gray level value (white color), before next frame time.

Similarly, in this embodiment, each sub frame, such as the sub frame $T_1$, is divided into three time segments $T_A$, $T_R$ and $T_B$. The time segment $T_A$ is the addressing time. The time segment $T_R$ is the response time for the liquid crystal molecule to rotate to a specific position. The time segment $T_B$ is the time for the backlight module to be turned on. Moreover, a larger over driving voltage is sent to the bottom scan line to accelerate the rotation velocity of the liquid crystal molecule located therein to compensate the difference of the response time. In the time segment $T_B$, all scan lines have the same integrated values of the brightness versus time curve. Therefore, a uniform gray-level brightness is represented in the liquid crystal panel in the time segment $T_B$.

Figures 7, 8:
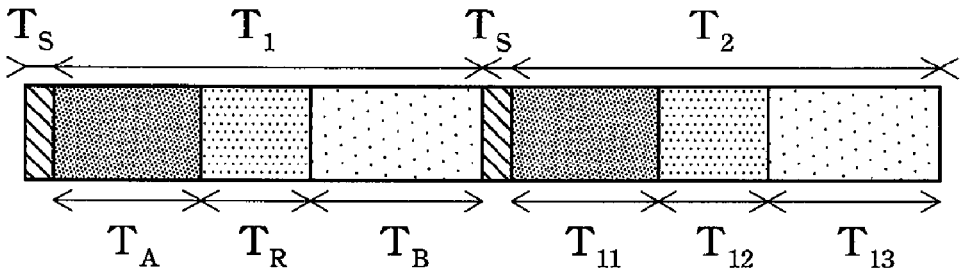
FIG. 7 is a schematic time sequence diagram used in a color sequential method, wherein a reset time is arranged between two sub-frames.
FIG. 8 is a simplified gray-level look up table.

On the other hand, the reset time $T_s$ may be arranged between two sub-frames as shown in FIG. 7. A reset time $T_s$ exists between two sub-frames $T_1$ and $T_2$. The main purpose of the reset time $T_1$ is to reset the display of the liquid crystal panel to a specific gray level value, such as 0 gray level value (black color) or 255 gray level value (white color), before the sub-frames $T_2$ Similarly, in this embodiment, each sub frame, such as the sub frame $T_1$, is divided into three time segments $T_A$, $T_R$ and $T_B$. The time segment $T_A$ is the addressing time. The time segment $T_R$ is the response time for the liquid crystal molecule to rotate to a specific position. The time segment $T_B$ is the time for the backlight module to be turned on.

In this embodiment, because a reset time $T_s$ exists between two sub-frames, the pixel unit is reset to a specific gray level value, such as 0 gray level value (black color) or 255 gray level value (white color) after each sub frame. When searching the gray level look up table, the gray level value of the previous frame in the look up table is a fixed value. Therefore, the gray-level look up table may be simplified to a table with two parameters, row number signal ($Y^{th}$) and the present gray-level value ($G_n$) as shown in FIG. 8. For example, a pixel unit is located in the first scan line in a liquid crystal panel. The present gray-level value ($G_n$) of this pixel unit is 128. The corrected gray-level value is 140. On the other hand, when a pixel unit is located in the middle scan line, such as the $384^{th}$ scan line, in a liquid crystal panel, the corrected gray-level value is 160. When a pixel unit is located in the bottom scan line, such as the $768^{th}$ scan line, in a liquid crystal panel, the corrected gray-level value is 200.

Figure 9:
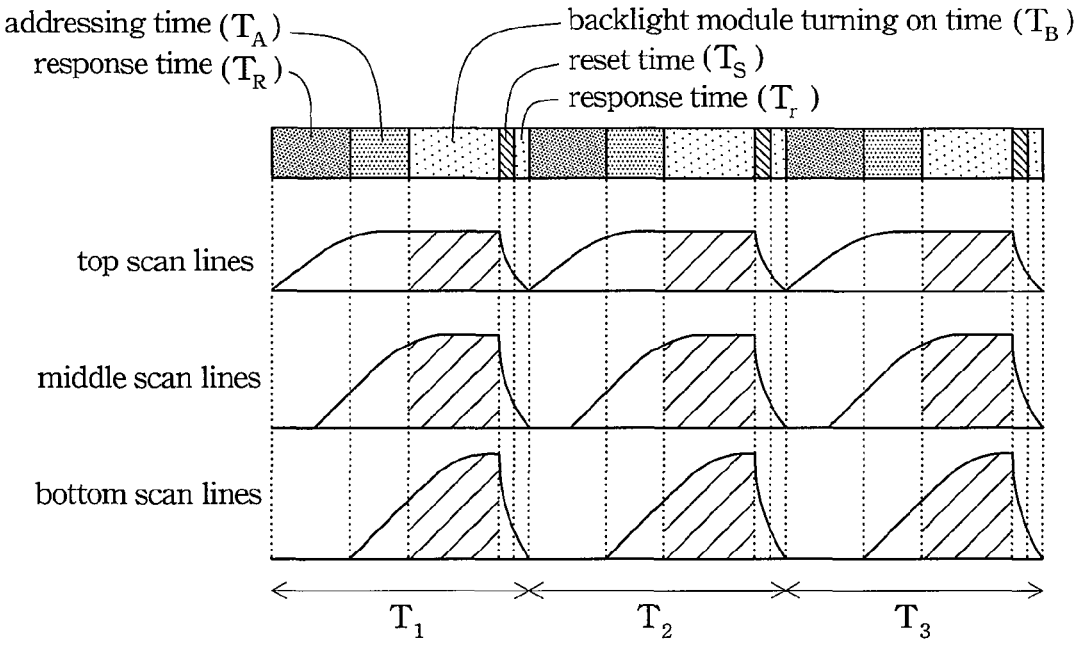
FIG. 9 is a schematic time sequence diagram used in a color sequential method according to the third embodiment of the present invention.

FIG. 9 is a schematic time sequence diagram used in a color sequential method according to the third embodiment of the present invention. In this embodiment, a reset time exists between two sub-frames. The whole panel is supposed to represent the same gray-level value. The frame time T is separated to three sub-frames $T_1$, $T_2$ and $T_3$. The three sub-frames $T_1$, $T_2$ and $T_3$ are used to sequentially show three primary colors in the persistence of vision time. A color is created by mixing the three primary colors.

Similarly, in this embodiment, each sub frame, such as the sub frame $T_1$, is divided into five time segments $T_A$, $T_R$, $T_B$, $T_s$ and $T_r$. The time segment $T_A$ is the addressing time. Because the color sequential method is used in this embodiment, an addressing process is required to apply voltage to corresponding address before each primary color is shown. The time segment $T_R$ is the response time for the liquid crystal molecule to rotate to a specific position. The time segment $T_B$ is the time for the backlight module to be turned on. When the liquid crystal molecule is rotated to a specific angle, the backlight module is turned on to show a specific primary color. The time segments $T_S$ is the reset time for resetting the display to a specific gray level value. In this embodiment, the display is reset to 0 gray level value (white color). The time segment $T_r$ is the response time for the liquid crystal molecule to rotate to a specific position.

Similarly, in this embodiment, because a reset time $T_s$ exists between two sub-frames, the pixel unit is reset to a specific gray level value after each sub frame. When searching the gray level look up table, the gray level value of the previous frame in the look up table is a fixed value. Therefore, the gray-level look up table may be simplified to a table with two parameters, row number signal ($Y^{th}$) and the present gray-level value ($G_n$) as shown in the FIG. 8. Moreover, a larger over driving voltage is sent to the bottom scan line to accelerate the rotation velocity of the liquid crystal molecule located therein to compensate the difference of the response time. In the time segment $T_B$, all scan lines have the same integrated values of the brightness versus time curve. Therefore, a uniform gray-level brightness is represented in the liquid crystal panel in the time segment $T_B$.

Figure 10:
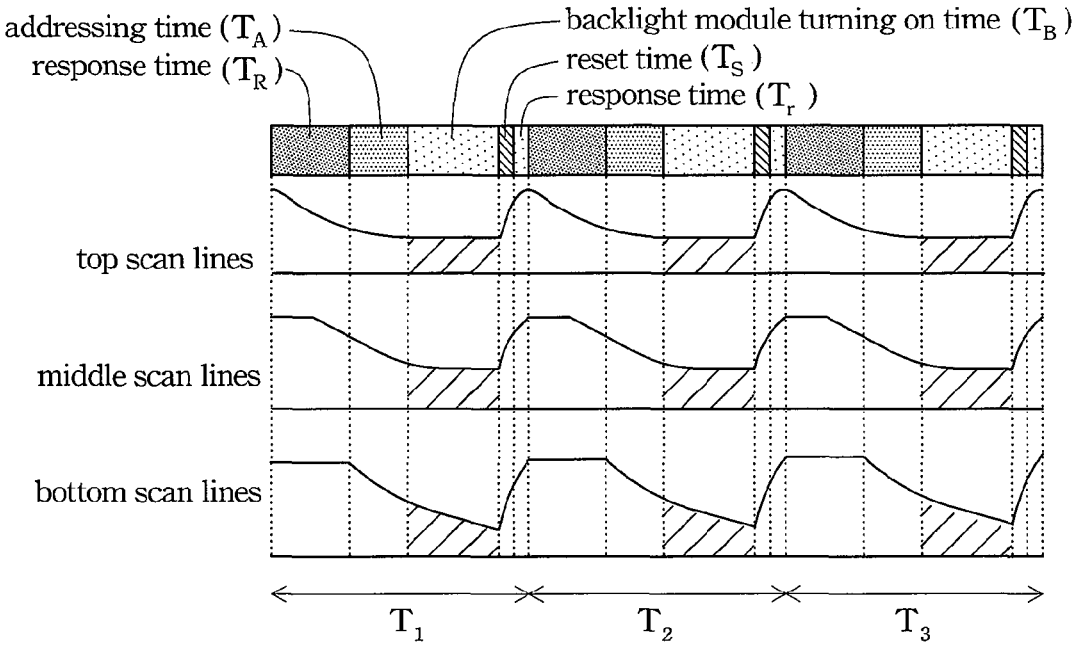
FIG. 10 is a schematic time sequence diagram used in a color sequential method according to the fourth embodiment of the present invention.

FIG. 10 is a schematic time sequence diagram used in a color sequential method according to the fourth embodiment of the present invention. Comparing with FIG. 9, the main difference is that, in this embodiment, the reset time segments $T_S$ is for resetting the display to a specific gray level value, 255 gray level value (white color).

Accordingly, the over driving circuit and operation method of the present invention is not only based on the gray-level values of the present and previous frame of a pixel unit but also based on the row number of this pixel unit. Therefore, when the whole panel is supposed to represent the same gray-level value, a larger over driving voltage is sent to the bottom scan line to accelerate the rotation velocity of the liquid crystal molecule located therein to compensate the difference of the response time because scan lines are scanned sequentially from the top to the bottom.

It has to be noticed that the main purpose why the whole panel displays image with the same gray-levels used as examples in the foregoing embodiments is to simplify the description. The present invention may be applied to display a colorful image.

As is understood by a person skilled in the art, the foregoing descriptions of the preferred embodiment of the present invention are an illustration of the present invention rather than a limitation thereof. Various modifications and similar arrangements are included within the spirit and scope of the appended claims. The scope of the claims should be accorded to the broadest interpretation so as to encompass all such modifications and similar structures. While a preferred embodiment of the invention has been illustrated and described, it will be appreciated that various changes can be made therein without departing from the spirit and scope of the invention.

What is claimed is:

1. An over driving method for a liquid crystal display, wherein the liquid crystal display includes a plurality of pixels to form a pixel matrix and each the pixel having a thin film transistor, comprising:

providing a modifier having a plurality of gray-level value look up tables, wherein each of the look up tables directly corresponds to one row number signal that indicates a row number of a pixel which row the pixel is located in the pixel matrix, and each row number signal only corresponds to one of the look up tables;

inputting a first gray-level value, a second gray-level value and the row number signal to the modifier;

directly using the row number signal to search one of the look up tables that directly corresponds to the row number signal;

obtaining a corrected gray-level value based on the look up table directly corresponding to the row number signal, the first gray-level value and the second gray-level value;

determining an over driving voltage based on the corrected gray-level value; and sending the over driving voltage to control the thin film transistor of the pixel located in the row number of the pixel matrix.

2. The over driving method of claim 1, wherein the corrected gray-level value is obtained by searching the gray-level value look up table.

3. The over driving method of claim 1, wherein the plurality of gray-level value look up tables in the modifier comprises a first reference gray-level value look up table and a second reference gray-level value look up table.

4. The over driving method of claim 3, wherein the gray-level look up table is obtained by linear interpolating the first reference gray-level value look up table and the second reference gray-level value look up table.

5. The over driving method of claim 3, wherein the first reference gray-level value look up table includes a first reference corrected gray-level value.

6. The over driving method of claim 5, wherein the first reference corrected gray-level value is obtained by searching the first reference gray-level value look up table.

7. The over driving method of claim 3, wherein the second reference gray-level value look up table includes a second reference corrected gray-level value.

8. The over driving method of claim 7, wherein the second reference corrected gray-level value is obtained by searching the second reference gray-level value look up table.

9. The over driving method of claim 1, wherein the first gray-level value is present gray-level value and the second gray-level value is previous gray-level value.

10. The over driving method of claim 9, wherein the second gray-level value is a fixed value composed of a plurality of bits.

11. The over driving method of claim 10, wherein the fixed value is between all bits equal to 0 and all bits equal to 1.

12. The over driving method of claim 1, further comprising:

inputting the over driving voltage to a switch device;

utilizing the switch device to control the rotation angle of liquid crystal molecule;

turning on a backlight module to generate light on liquid crystal molecule; and generating a curve of brightness versus time through the operation of liquid crystal molecule.

13. The over driving method of claim 12, wherein integrated values of the brightness and time in a sub-frame of the curve are all identical in the liquid crystal display.

14. An over driving circuit of a liquid crystal display, wherein the liquid crystal display includes a plurality of pixels to form a pixel matrix and each the pixel having a thin film transistor, comprising:

a buffer for outputting a first gray-level value;

a memory coupling with the buffer for receiving the first gray-level value and outputting a second gray-level value; and a modifier coupling with the buffer, the memory and a signal line, wherein the modifier having a plurality of gray-level value look up tables, wherein each of the look up tables directly corresponds to one row number signal that indicates a row number of a pixel which row the pixel is located in the pixel matrix, and each row number signal only corresponds to one of the look up tables;

wherein the modifier receives the first gray-level value, the second gray-level value and the row number signal and directly uses the row number signal to search one of the look up tables that directly corresponds to the row number signal and obtains a corrected gray-level value based on the look up table directly corresponding to the row number signal, the first gray-level value and the second gray-level value, and the corrected gray-level value is used to determine an over driving voltage, and the over driving voltage controls the thin film transistor of the pixel located in the row number of the pixel matrix.

15. The over driving circuit of claim 14, wherein the plurality of gray-level value look up tables in the modifier further comprises a gray-level value look up table related to the row number signal.

* * * * *